US008070921B2

(12) United States Patent
Linnerud et al.

(10) Patent No.: US 8,070,921 B2
(45) Date of Patent: Dec. 6, 2011

(54) METHOD FOR ELECTRICAL CONNECTION AND MAGNETIC COMPENSATION OF ALUMINIUM REDUCTION CELLS, AND A SYSTEM FOR SAME

(75) Inventors: Glenn Ove Linnerud, Ski (NO); Reidar Huglen, Vormedal (NO)

(73) Assignee: Norsk Hydro ASA, Oslo (NO)

( * ) Notice: Subject to any disclaimer, the term of this patent is extended or adjusted under 35 U.S.C. 154(b) by 1217 days.

(21) Appl. No.: 11/663,279

(22) PCT Filed: Sep. 16, 2005

(86) PCT No.: PCT/NO2005/000343

§ 371 (c)(1),
(2), (4) Date: Jun. 6, 2007

(87) PCT Pub. No.: WO2006/033578

PCT Pub. Date: Mar. 30, 2006

(65) Prior Publication Data

US 2007/0256930 A1 Nov. 8, 2007

(30) Foreign Application Priority Data

Sep. 23, 2004 (NO) ..... 20044012

(51) Int. Cl.
*C25C 1/00* (2006.01)
*C25C 3/00* (2006.01)
*C25C 7/00* (2006.01)

(52) U.S. Cl. ..... 204/265; 204/267; 204/243.1; 204/247.1; 205/347

(58) Field of Classification Search ..... 204/265, 204/267, 243.1, 247.1; 205/347
See application file for complete search history.

(56) References Cited

U.S. PATENT DOCUMENTS

| | | | | |
|---|---|---|---|---|
| 3,616,317 | A | 10/1971 | McLellan | |
| 3,756,938 | A * | 9/1973 | Nebell | 204/244 |
| 4,072,597 | A * | 2/1978 | Morel et al. | 205/347 |
| 4,169,034 | A * | 9/1979 | Morel et al. | 204/279 |
| 4,313,811 | A | 2/1982 | Blanc | |
| 4,713,161 | A | 12/1987 | Chaffy et al. | |

FOREIGN PATENT DOCUMENTS

| | | |
|---|---|---|
| EP | 0 371 653 | 6/1990 |

* cited by examiner

*Primary Examiner* — Harry D Wilkins, III
*Assistant Examiner* — Zulmariam Mendez
(74) *Attorney, Agent, or Firm* — Wenderoth, Lind & Ponack, LLP

(57) ABSTRACT

The present invention relates to a method and a system for electrical connection between the successive cells (pots) arranged in series for the production of aluminium by electrolysis of alumina dissolved in molten cryolite, by the Hall-Heroult process. The invention is applied to series of cells arranged transversely to the axis of the series (line) and operating at a current greater than 300 kA and possibly above 600 kA. The present invention combines the different advantages of known design concepts into effective novel technical solutions for large pots. The solution optimises the resulting magnetic field and busbar performance parameters like voltage drop, weight, current distribution, distribution and average levels of magnetic field, inter-row distance, anode riser solutions and physical space for the busbar requirements.

16 Claims, 12 Drawing Sheets

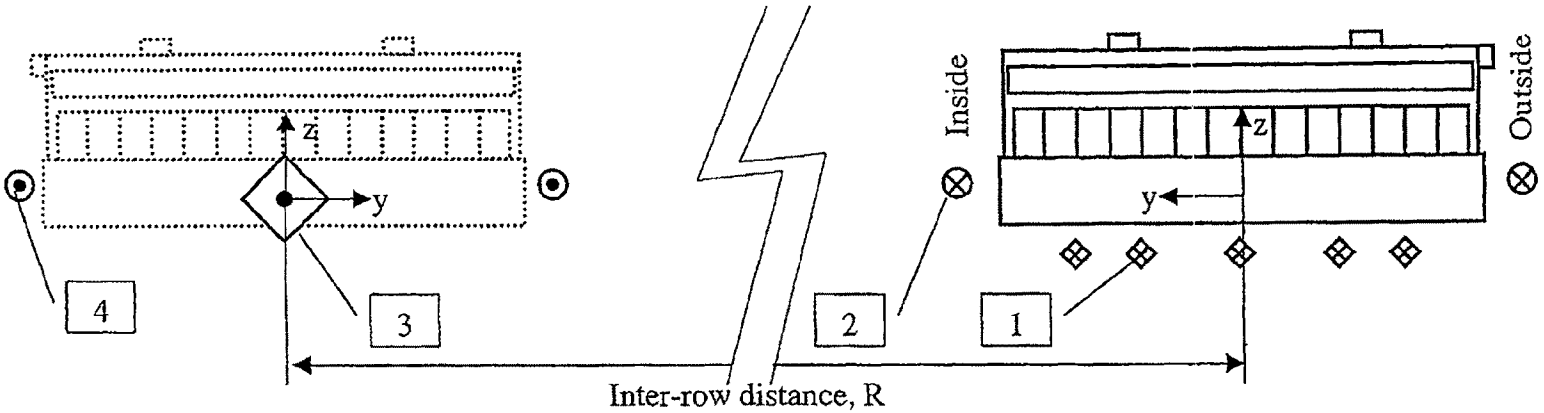
Figure 1. Cross section of one potline

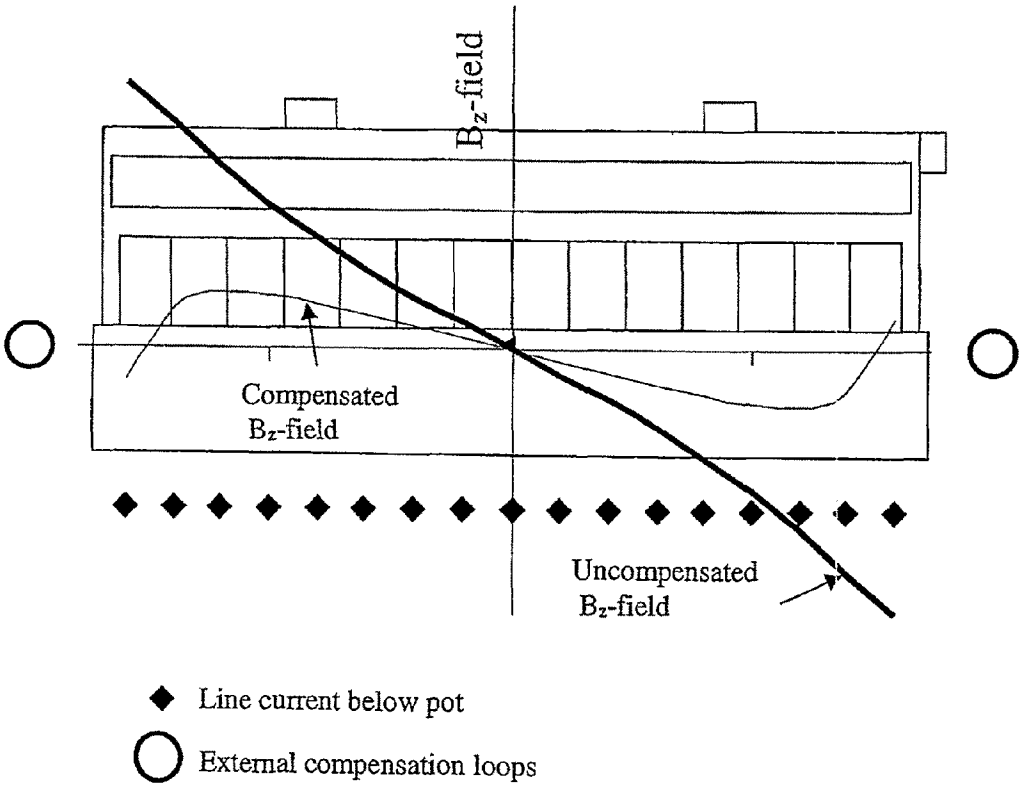
Figure 2. $B_z$-field in electrolyte-metal level

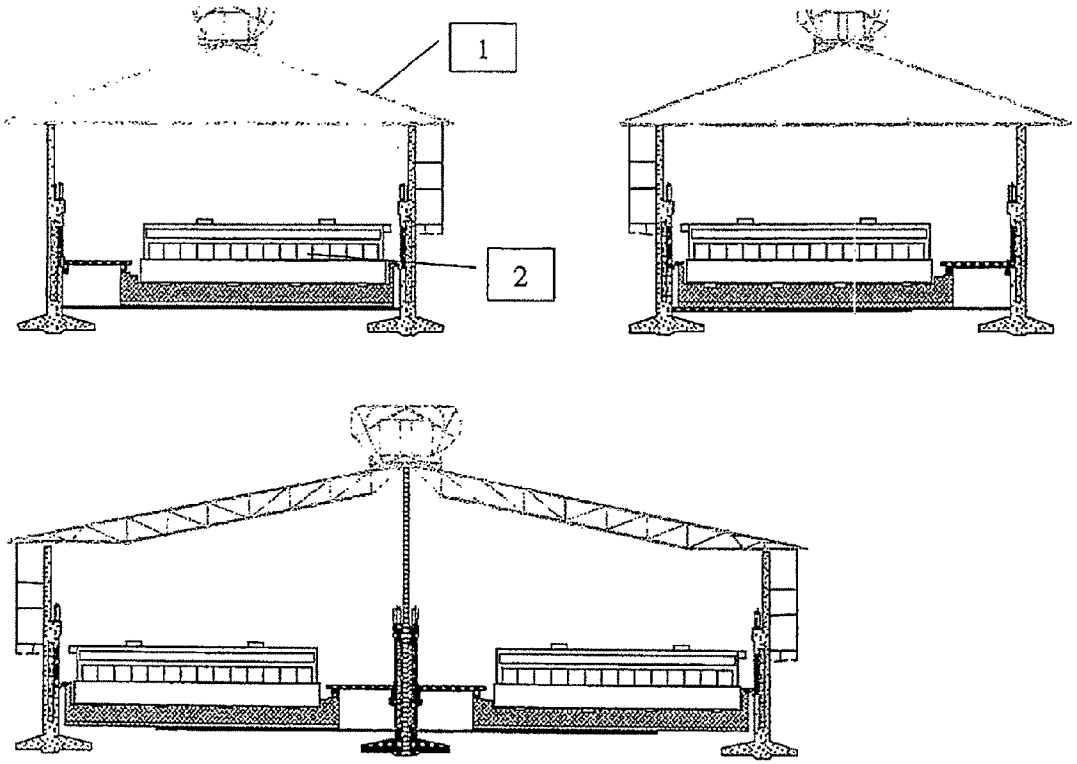
Figure 3. Single (top) and double (bottom)pot rooms

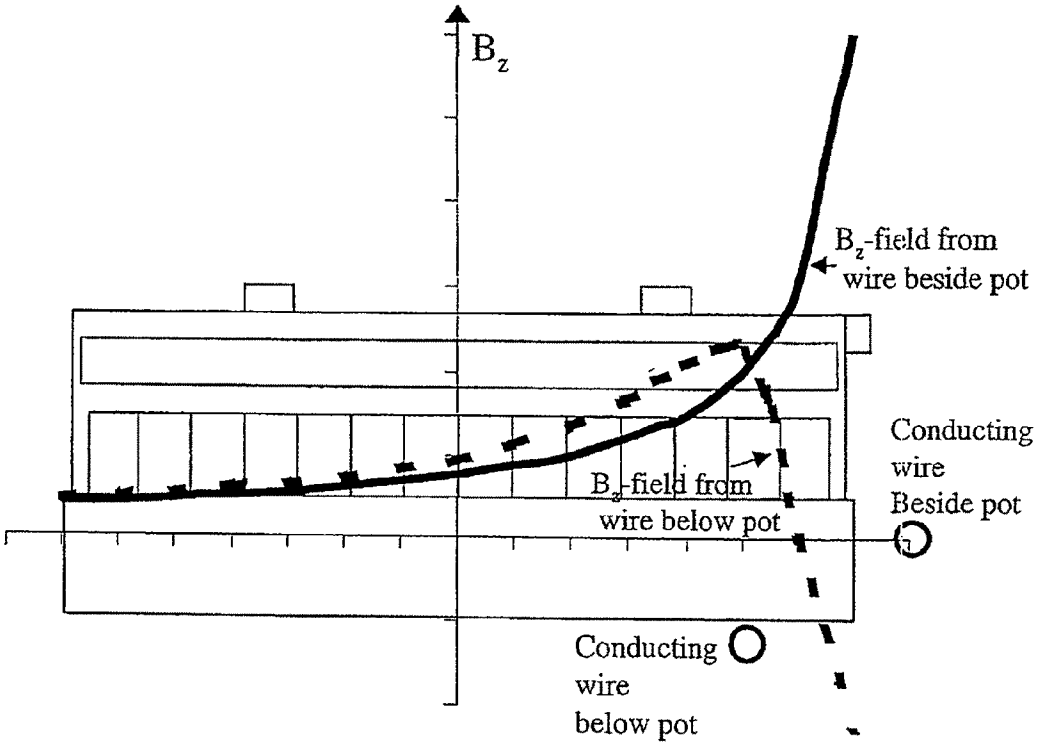
Figure 4. Compensation below and beside the pot head

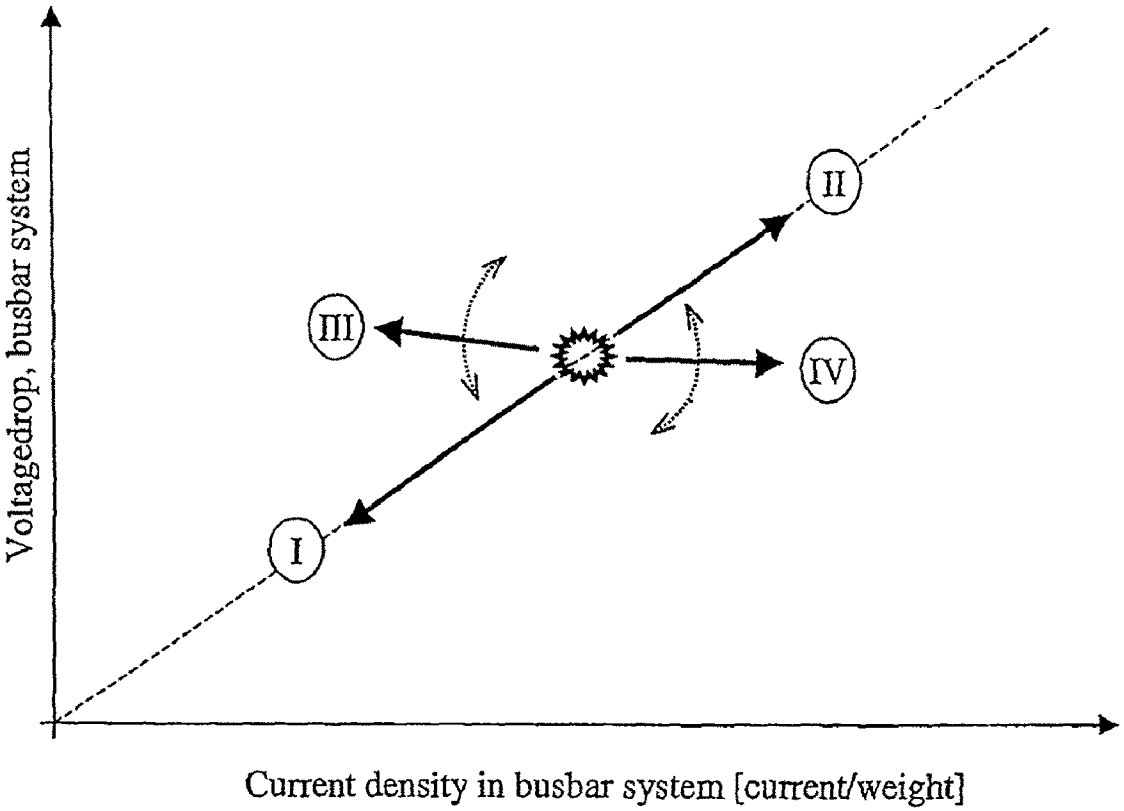
Figure 5. Voltage-drop/weight/stability dilemma

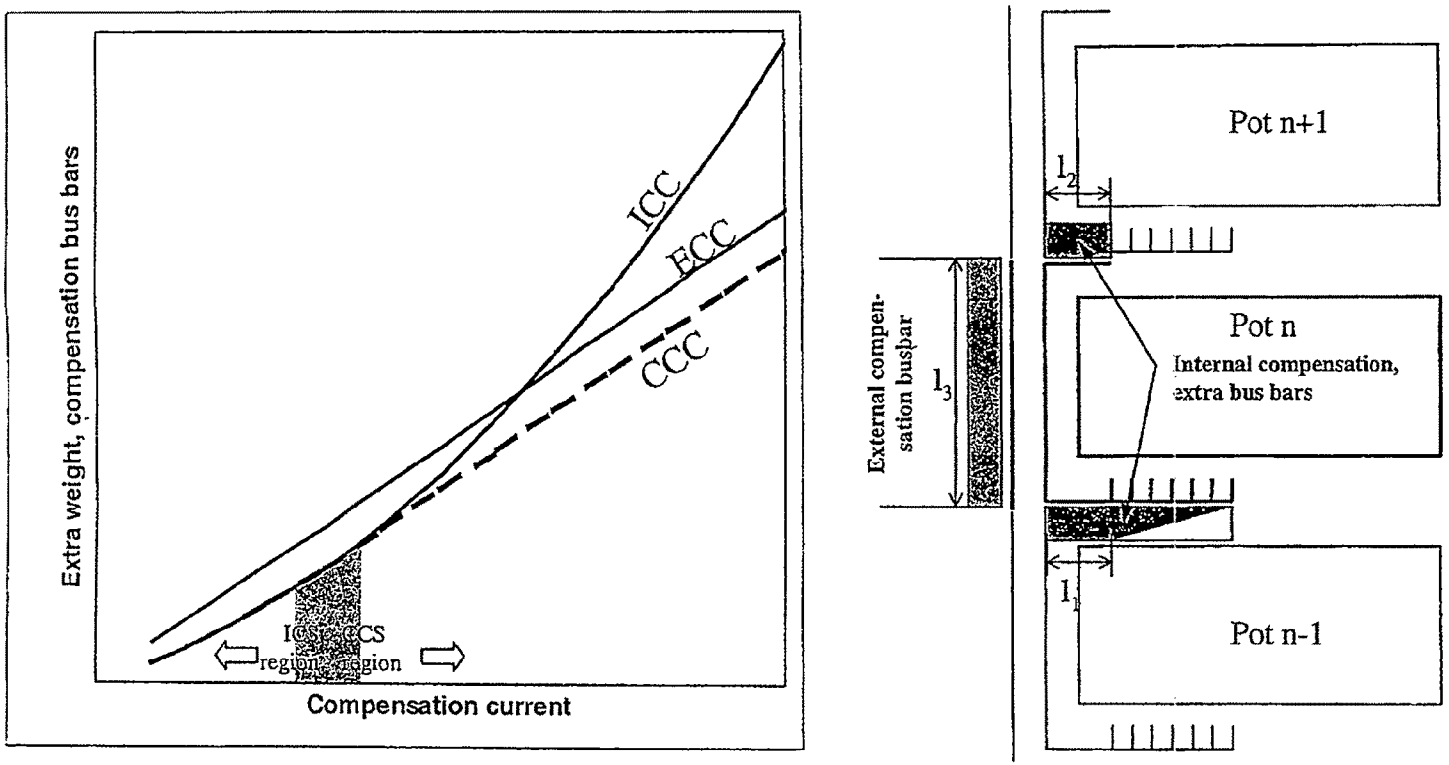
Figure 6. Extra busbar weight

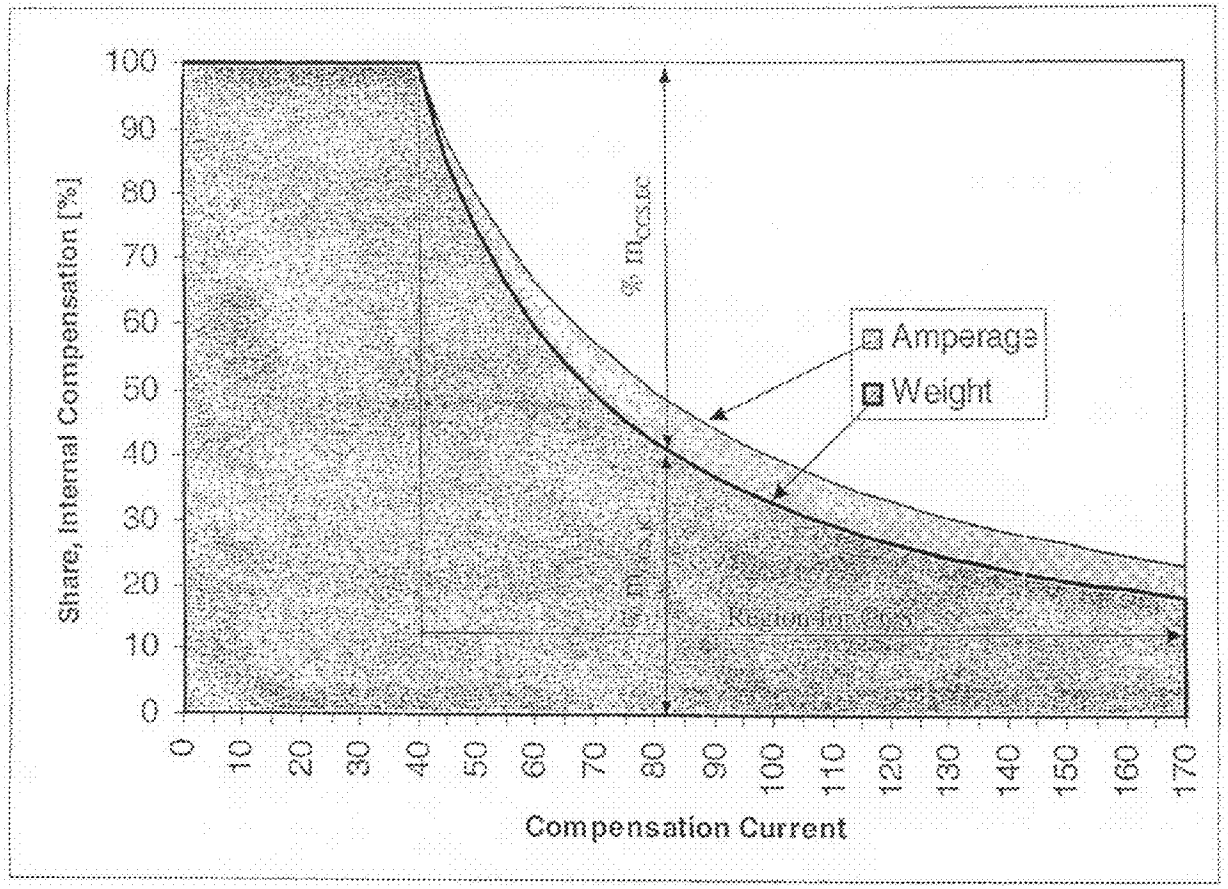
Figure 7. Share of internal compensation

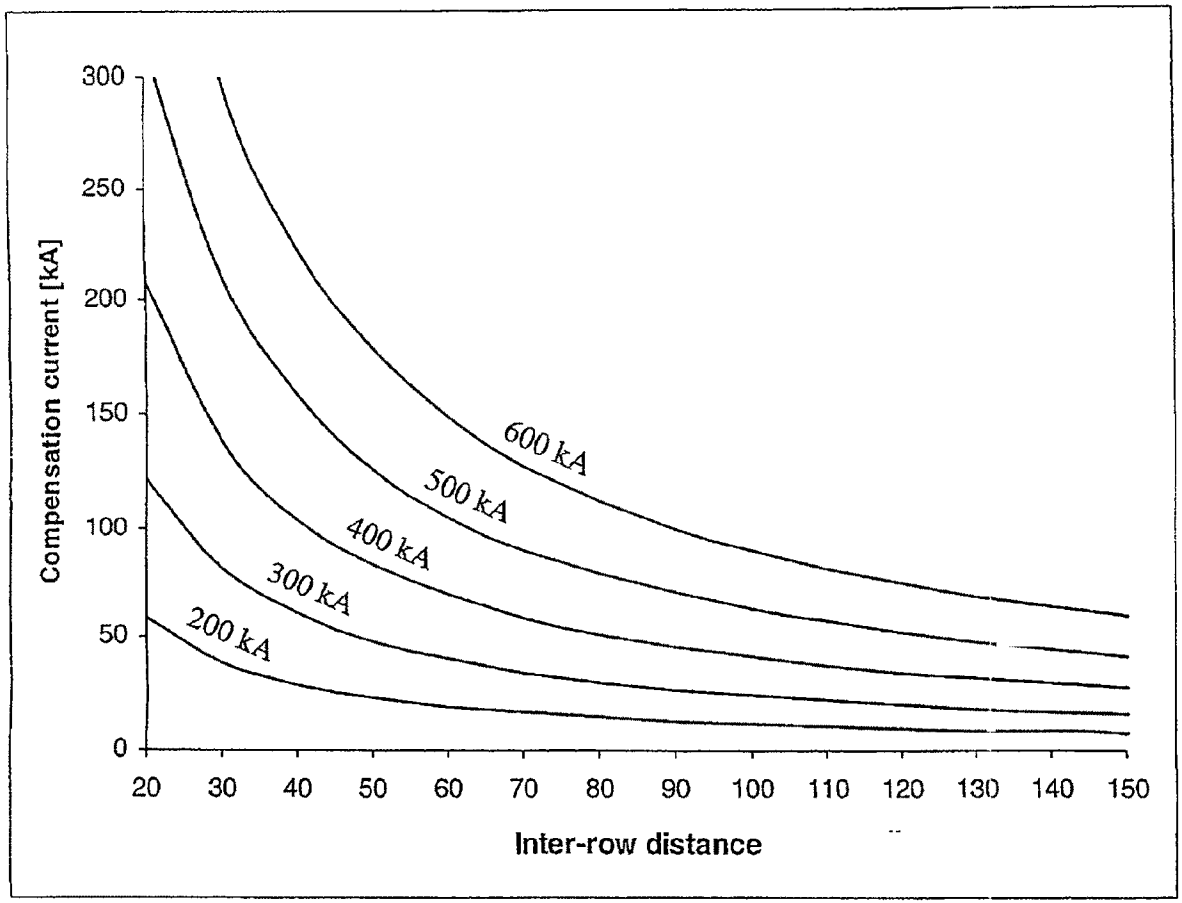
Figure 8. The influence of the inter-row distance

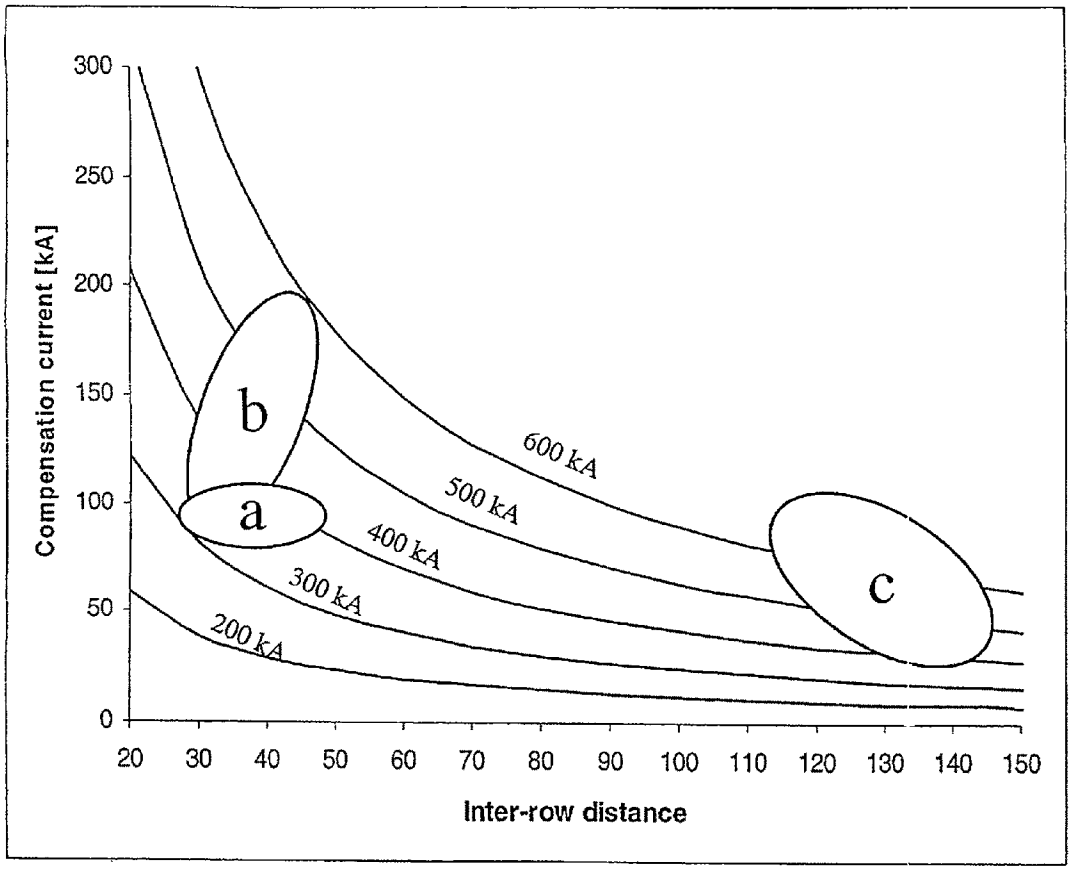
Figure 9. Categories of pots to be compensated

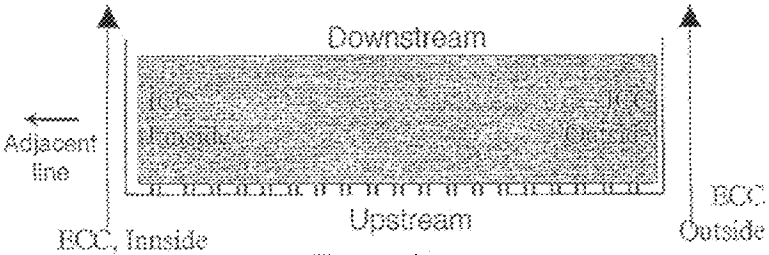
Figure 10.a
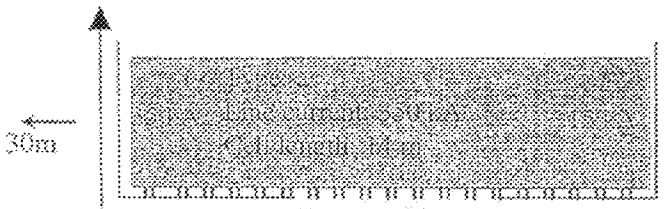
Figure 10.b
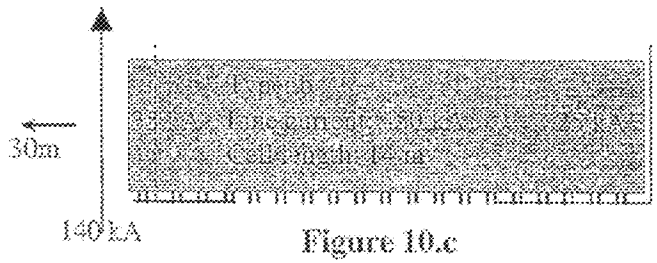
Figure 10.c
Figure 10. Examples of layouts of the different combined compensations

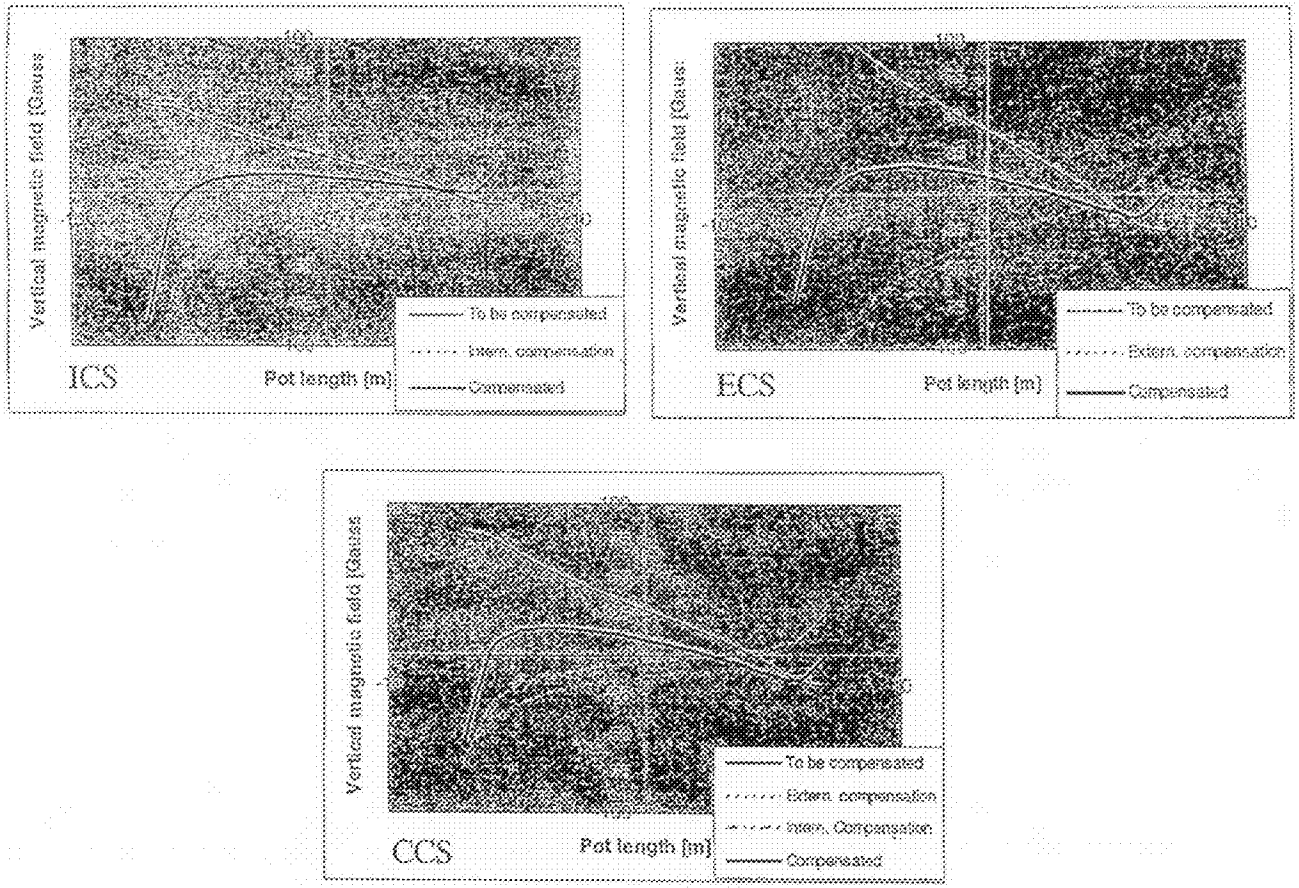
Figure 11. The effect of 350 kA, ICS, ECS AND CCS at 350 kA

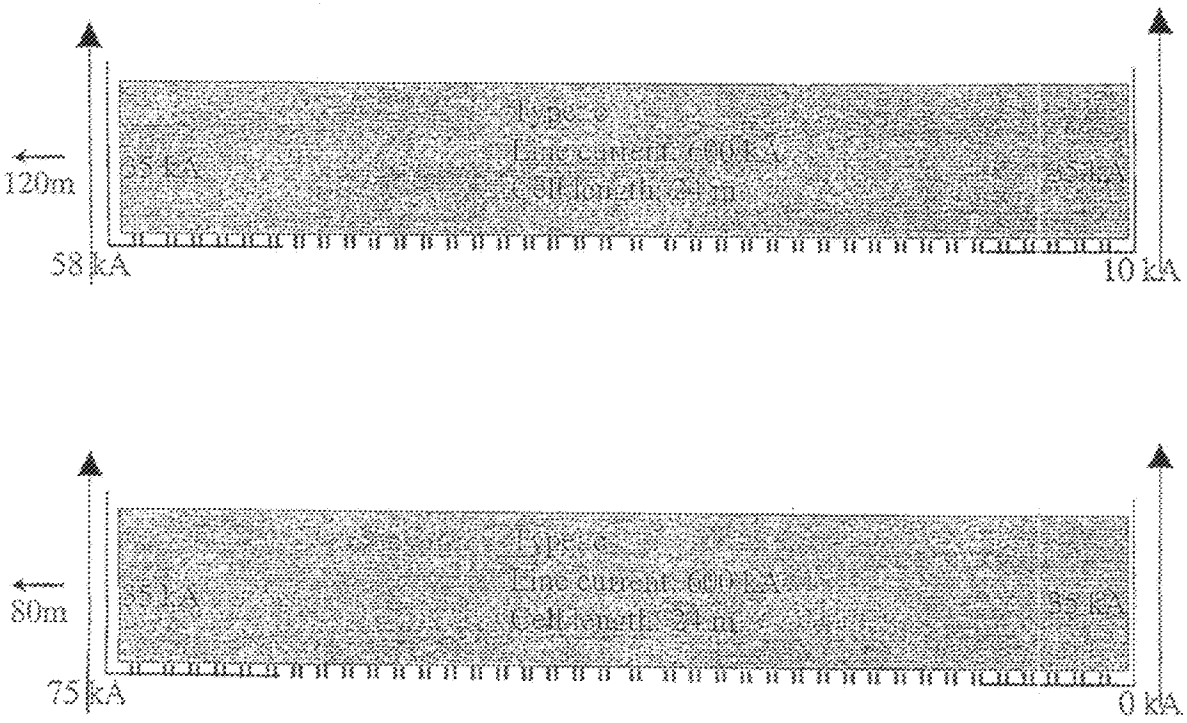
Figure 12. Large cell, different inter-row distances

METHOD FOR ELECTRICAL CONNECTION AND MAGNETIC COMPENSATION OF ALUMINIUM REDUCTION CELLS, AND A SYSTEM FOR SAME

The present invention relates to a method and a system for electrical connection between successive cells (pots) arranged in series for production of aluminium by electrolysis of alumina dissolved in molten cryolite, by the so-called Hall-Héroult process, and to the magnetic compensation of same. The invention is preferably applied to series of cells arranged transversely to the axis of the series (line) and operating at a current greater than 300 kA and possibly above 600 kA.

The present invention combines the different advantages of known layouts into cost-effective technical solutions for large pots. The solution optimises a combination of the resulting magnetic field with busbar performance parameters like voltage drop, weight, current distribution, distribution and average levels of magnetic field, anoderiser solutions and physical space for busbar requirements.

TECHNICAL FIELD OF THE INVENTION

For good understanding of the invention, it should first be remembered that the industrial production of aluminium is made by electrolysis in cells, which are connected electrically in series, with a solution of alumina in molten cryolite brought to a temperature typically between 930 and 970° C., by the heating effect of the current traversing through the cell.

Each cell is constituted by an insulated parallelepiped steel container supporting a cathode containing prebaked carbon blocks in which there are sealed some steel rods known as cathode current collector bars, which conduct the current out of the cell, traditionally 50% upstream and 50% downstream. The cathode current collector bars are connected to the busbar system, which serve to conduct the current from the cathodes towards the anodes of the following cell. The anode system, composed of carbon, steel and aluminium, is fixed on a so-called "anode frame", with anode rods adjustable in height and electrically connected to the cathode rods of the preceding cell.

The electrolyte, that is the solution of alumina in a molten cryolite mixture at 930-970° C., is located between the anode system and the cathode. The aluminium produced is deposited on the cathode surface. A layer of liquid aluminium is kept permanently on the bottom of the cathode crucible. As the crucible is rectangular, the anode frame supporting the anodes is generally parallel to its large sides, whereas the cathode rods are parallel to its small sides known as cell heads.

The main magnetic field in the cell is created by the current flow in the anode and the cathode system. All other current flows will give perturbations to this created main field.

The cells are arranged in rows and are disposed transversely in a side-by-side orientation; their short side is parallel to the axis of the potline. Commonly, one potline is represented by two rows of cells. The current has opposite directions in the two rows. The cells are connected electrically in series, the ends of the series being connected to the positive and negative outputs of an electric rectification and control substation. The electric current traversing the various conducting elements: anode, electrolyte, liquid metal, cathode and connecting conductors, creates large magnetic fields. These fields, together with the electrical current in the liquid electrolyte and metal, form the basis for the Magneto Hydro Dynamic (MHD) behaviour in the electrolyte and in the liquid metal contained in the crucible. The so-called LaPlace forces, which create electrolyte and metal flow, are also harmful to the steady operation (stability) of the cell. The design of the cell and of its connecting conductors is such that the effects of the magnetic fields created by the various portions of the cell, its adjacent and neighbouring cells, and the connecting conductors should balance one another. FIG. 1 shows a cross section of two cells in one potline.

Definitions

Line Current

The DC electric current passing through the cells, supplying energy for the electro-chemical reactions taking place inside each cell.

Potline

A potline consists of a number of pots connected to each other in a series, with line current supplied from a rectifier group to the circuit. Normally, this circuit is organised in two (or four) parallel rows, with the neighbouring or adjacent row(s) carrying the current in the opposite direction of each other.

Consideration of One Row Containing the Cell(S) to be Compensated (Row Compensation)

When discussing compensation of one row of cells, the effect of the adjacent row(s) is disregarded. An electrical circuit is made when subsequent cells are connected into a circuit. This connection, dependent on the design and size of single cells and the connecting busbars, creates a magnetic field itself, which has to be compensated, or modified, to balance the resulting magnetic field of the cell itself, created by the current path through the cell and between next neighbour cells upstream and downstream. Example is found in FIG. 2.

Row compensation denotes the compensation of the magnetic field created by this local cell-to-cell current path(s).

Compensation of Neighbour Row

One row of pots Is normally arranged in the vicinity of one or more pot rows.

Two rows of pots normally constitute one potline. The flow of current is in opposite directions in the two rows, as seen in FIG. 1.

Neighbouring potlines are normally divided in two or four pot rows.

The neighbour pot rows carry the line current, as well as other current loops, as the case may be. The sum of the contributions (dependent on current and inter-row distance) from all the current loops in the neighbour row influences the magnetic field of the cell(s) to be compensated in the actual row. The neutralization of the resulting magnetic fields, created by the current in the neighbour rows, is denoted "neighbour row compensation".

The contribution from the neighbour row is not constant over the pot area. The magnetic field contribution, B, follows the Biot-Savart law:

$$B = \frac{2 \cdot I_p}{R} \text{[gauss]} \tag{1}$$

where R is the distance from the source, and $I_p$ is the current in the source (conducting wire).

The consequence is that the magnetic field B varies over the cell area, and the gradient over the cell $$\left(\frac{dB_z}{dy}\right)$$

is getting stronger when the distance to the neighbour row decreases.

Inter-Row Distance

The strength of the vertical magnetic field from the neighbour row(s) depends on the amount of current through the neighbour row, and on the inter-row distance, according to the Biot-Savart law.

If solutions are made, which makes it possible to place two rows between 20 and 40 m apart from each other; both rows could be situated in one common potroom, a so-called double potroom, shown in FIG. 3. This solution opens up for investment cost savings related to potroom building and site.

If the cost savings related to potrooms and site are less than the cost of the extra busbars needed to achieve the needed compensation in the double potroom, the row distance will be increased to more than 40 meters, with the potroom divided into two single potrooms, one for each pot row, as seen in FIG. 3. The inter-row distance is ultimately a balance between the involved cost components and the challenge and complexity of balancing of the magnetic fields, which increase with increasing amperage and decreasing inter-row distance.

Internal Compensation

"Internal compensation" is carried out by manipulation of the busbars connected to, and surrounding the pot, carrying the line current.

In a general perspective, current loops below and beside the pot footprint are relevant for changing the shape of the magnetic field. In the present document, the term "internal compensation" includes the part of the current collected from the cell number n, and carried to the next cell number n+1, in a path both below the cell, inside the footprint (type 1) and close to electrolyte-metal level outside of the footprint (type 2) of the cell n. The type 2 (path outside of the cell footprint) is normally the most powerful way of compensating the vertical magnetic field component ($B_z$), see FIG. 4.

The path of the compensation current could either be between the two involved rows (inside), or on the outside of the line current loop (outside).

Abbreviations:

IC: Internal Compensation

ICC: Internal Compensation Current

ICS: Internal Compensation System

External Compensation

If the current used for compensating the cell is independent of the line current, it is denoted external compensation current. The external compensation current then carries out the external compensation.

It may be supplied from the same source of direct current, by two branches from the same source or by a separate power supply (boosters). External compensation is a supplement to, or a substitution for the internal compensation and vice versa, as the case may be. The path of the external compensation current could either be between the two involved rows (inside), on the outside of the line current loop (outside), preferably located at the same level as that of the metal reservoir (more seldom below the pots). External compensation compensates vertical magnetic field components ($B_z$) only, when placed at the liquid metal level, see FIG. 4.

The direction of the external compensation current may be both parallel to the cell current, or opposite, depending on the compensation need.

Abbreviations:

EC: External Compensation

ECC: External Compensation Current

ECS: External Compensation System

Combined Compensation

Combined compensation (combining internal and external compensation) is defined with the following abbreviations:

CC: Combined Compensation

CCC: Combined Compensation Current (sum of ICC and ECC)

CCS: Combined Compensation System

CCS,IC: Internal compensation part of Combined Compensation System

CCS,EC: External compensation part of Combined Compensation System

STATEMENT OF THE PROBLEM

The design of busbars for aluminium production cells is knowledgewise one of the more qualified key activities in developing a competitive aluminium reduction technology.

This is illustrated by this extensive list of important investment and operational cost factors influenced by the design of the busbars:

- The MHD movements generated by LaPlace forces ($\vec{F} = \vec{i} \times \vec{B}$)
  - The pot stability, which is determined by the balancing of the magnetic field.
  - The cathode current distribution, upstream/downstream, traditionally 50% on each side.
  - The current distribution along the upstream side and along the downstream side.
  - The inter-row distance.
- The weight and complexity of the busbar.
- The electrical resistance in the busbar system.
- The ground area needed for the series of cells.
- The distance between subsequent cells.
- The cost for construction and installation of the circuits.
- The size of the electrolyte/metal area (length of cell) with increasing amperage.
- The temperature of the busbars.
- The risk of short-circuiting.

The designer has several degrees of freedom in the process of developing an optimum busbar system, using skill to select a configuration (topology), which conforms to the needs in the above list.

Given a configuration, the designer's selection of busbar lengths and cross-sectional areas will balance the voltage-drop/weight/stability dilemma, as stated in FIG. 5. The busbar system should be designed with an optimum balance between the voltage drop determined by the expected cost of the electrical power during the smelter life, and the investment cost determined by the material cost of the electric conductors and the manufacturing and installation cost. For a given design (configuration) this economical optimisation process is done with a Net Present Value-analysis. The preferred solution lies somewhere along the configuration-specific line in FIG. 5.

The presence of electric current and magnetic field creates LaPlace forces, which cause MHD movements in the liquid electrolyte and metal and subsequently deformation of the metal-electrolyte interface due to a low damping (small difference in density between liquid electrolyte and metal). The magnetic field vertical component, $B_z$, together with horizontal electrical current components in the liquid metal, are the major cause of undesirable LaPlace-forces, destabilising the pot. The resulting electrolysis yield (current efficiency) may be greatly diminished and the energy consumption is thereby increased.

The adjacent row(s) create a magnetic field superimposing the local magnetic field and make it more asymmetric. The effect of the magnetic field created by the adjacent row (including any external compensation current) has to be neutralized.

In order to arrange large, complex-shaped conductors between the cells, it may be necessary to increase the distance between the subsequent cells. This further may lengthen the electric circuit and increase the surface of the site and building area required for these cells.

The more the intensities of the cells increase, the more their dimensions increase (transversal length). An increased area of the liquid layers (electrolyte/metal area) increases the sensitivity to the magnitude and gradient of the magnetic fields. The design of the connecting conductors then becomes more complicated.

PRIOR ART

The present invention is achieved in an area where several patents have been published in the last 35 years. Both row and neighbour row compensation, with internal as well as external compensation are well documented and described. However, most patents describe magnetic field compensation for cells below 300 kA, and even below 200 kA. A comprehensive review of the principles in the field of magnetic compensation is given by R. Huglen in K. Grjotheim and H. Kvande: "Introduction to Aluminium Electrolysis", Aluminium Verlag, Düsseldorf 1986 and 1993.

The fundamental understanding, which forms the basis for the present invention, was not described, since the scientific understanding then was not available neither in literature nor in patents.

A main limitation related to prior art is the understanding needed to distinguish between good and less good solutions.

The variations in line current, inter-row distance, voltage drop, busbar weight, and pot operational stability have never been described in a way that made comparison of performance practicable.

The following table shows the main patents, with the focus areas indicated.

| Pat. No. | Author | Year | Internal comp. | External comp. | Row Comp. | Neighbour row_Comp. |
|---|---|---|---|---|---|---|
| U.S. Pat. No. 4,713,161 | Chaffy et al. | 1987 | (X) | X | X | X |
| FR 2 505 368 | Homsi | 1981 | X | | X | X |
| U.S. Pat. No. 4,072,597 | Morel | 1978 | X | | | X |

An explicit difference between prior art and the present invention is the part of the line current carried from the upstream side of the pot, outside of the cell footprint.

While the present invention carries between 5 and 25% of the line current outside of the footprint, the rest of the patents are different.

The solution in U.S. Pat. No. 4,072,597 carries 50% of the line current (all upstream current) outside of the footprint.

U.S. Pat. No. 2,505,368 carries 25 to 30% of the fine current outside of the footprint.

U.S. Pat. No. 4,713,161 carries 0% of the line current outside of the footprint.

SHORTCOMINGS, PRIOR ART

The prior art deficiencies described in U.S. Pat. No. 4,713,161, are also relevant for the technical basis for the present invention.

In addition, U.S. Pat. No. 4,713,161. has the following shortcomings:

- If the transversal collectors between the pots could have been entirely removed and the space between the pots reduced correspondingly, the length reduction of the busbars would have had a large effect on the weight/voltage drop, but collectors are always needed, as well as the anode risers. The indicated number of anode risers is high, with a subsequent disadvantage related to busbar complexity, anode change and shunting of cells.
- High current in external compensation busbars increases the need of row compensation, or increase of the inter-row distance.
- If the upstream part of the line current follows the shortest path below the cell, the external compensation busbar must be located at a relatively longer distance away from the cell head, to impose a magnetic field with a low gradient. This must be done to achieve a better fit between the $B_z$ field created by the line current and the opposite directed $B_z$ field created by the compensation current. The consequence of the longer distance is relatively higher current, with a correspondingly higher weight and/or voltage drop.
- If the compensation current supply has a breakdown, the cell will become extremely unstable. The Current Efficiency (CE) will certainly get low, and the electrolyte and liquid metal movements will be adversely affected.
- The large external compensation busbars need space, support and shielding, which requires a wider basement, with its extra investment cost.
- The external compensation busbar is located just below the potroom floor, creating an extraordinary strong magnetic field at the ends of the cell.

A main concern is related to the magnitude of the $B_z$ gradient created by the external compensation busbar over the cathode area. An increased compensation current creates an increased $B_z$ gradient over the transversal length of the cell. This gradient can be neutralized or made less harmful by either moving the compensation busbar away from the cell head, or by modifying the layout of the busbars beneath the cell, to better match the shape of the vertical magnetic field created by the external busbar. Both methods will increase the busbar weight and/or the voltage drop.

The resulting effect of the busbar below and inside the cell footprint and busbar outside of the cell footprint, is fundamentally different and is illustrated in FIG. 4.

In accordance with the present invention as stated in the method claims, 1-6, an optimised busbar system can be achieved that overcomes main short comings of prior art designs. Claims 7-16 defines such a system.

The present invention shall in the following be described by figures and examples where:

FIG. 1 discloses cross section of one potline (prior art),

FIG. 2 discloses $B_z$ field in electrolyte-metal level (prior art),

FIG. 3 discloses single and double potroom designs (prior art),

FIG. 4 discloses compensation below and beside the pot head (prior art),

FIG. 5 discloses voltage-drop/weight/stability dilemma,

FIG. 6 discloses extra busbar weight,

FIG. 7 discloses share of internal compensation,

FIG. 8 discloses the influence of the inter-row distance,

FIG. 9 discloses categories of pots to be compensated,

FIG. 10 discloses layouts of the different combined compensations,

FIG. 11 discloses 350 kA cells and compensation design (ICS, ECS and CCS),

FIG. 12 discloses large cell and different inter-row distances.

STATEMENT OF THE INVENTION

The present invention relates to a method and a system for electrical connection between the successive cells arranged in series for industrial production of aluminium, and more precisely, an arrangement of conductors allowing transversely arranged electrolysis cells to be operated at more than 300 kA and up to 600 kA with a current efficiency from 93 to 97%, while improving the technical and economical performance of the conductor systems, including the busbars between cells and the busbars in the external compensation system.

The present invention is based on new insight into the advantages and disadvantages of the known methods for busbar design. It is entirely different from the conceptions of the prior art and involves utilizing the better features of the two existing compensation methods to yield a solution with lower weight and low energy consumption.

It is therefore described a system allowing cost optimisation of the design so as to reduce the investment and operational cost. It is finally a device allowing the magnetic field created by the adjacent rows to be compensated without excessive expenditure. This could allow for lower inter-row distance concepts for cells with higher amperage than the state-of-the-art, including the double potroom technology.

A normal combination or a traditional consideration, related to combinations of internal and external compensation does not achieve the gains, as opposed to the gains presented in the present invention, because;

- It is found that the line current has to pass 300 kA before the effects emerge. Potlines below this current limit are normally doing better with internal compensation only.
- The designers of the busbar system must understand where the gain is to be achieved.

An internally compensated potline modified to a combined potline by introducing an external loop, simply in order to compensate for an adjacent row, falls outside the main scope of this invention, since the full potential of the internal compensation method of such a design is underestimated.

Further, the present invention is based upon the finding that the internal compensation current (CCS,IC), should be in the interval 5 to 25% of the line current.

Preferably, the magnitude of the external compensation current (CCS,EC) is between 5 and 80% of the magnitude of the line current.

Both an external and an internal compensation system add extra weight (and consequently extra cost) to the busbar system surrounding the pots, but the extra weight is introduced in very different ways, for the two methods.

The weight of the external compensation busbars, $m_{ECS}$, is proportional to the compensation current.

$$m_{ECS} = I_{ECS} \cdot \frac{\delta \cdot l_3}{i} \tag{2}$$

$I_{ECS}$ Current in external compensation busbars, [kA] ($I_{CCS,EC}$ for a Combined Compensation System)

$m_{ECS}$ Extra mass for the compensation busbars, [kg] ($m_{CCS,EC}$ for a combined compensation system)

i Current density in busbars, [kA/dm$^2$]

□ mass density of busbar material, [kg/dm$^3$]

$l_3$ c-c distance, from cell n to n+1[dm]

The weight increase created by the internal compensation method is a function of how long distance along the upstream cell sidewall the current collection must take place. The weight of extra busbars ($m_{ICS}$) is approximated by this type of equation (calculation of weight of extra busbars, shown in FIG. 6, right side):

$$m_{ICS} = I_{ICS} \cdot \frac{\delta}{i} \cdot \left(l_1 + l_2 + \frac{I_{ICS}}{a} \cdot b\right) \tag{3}$$

$I_{ICS}$ Current in internal compensation busbars ($I_{CCS,IC}$ for a combined compensation system)

$m_{ICS}$ Extra mass for the compensation busbars ($m_{CCS,IC}$ for a combined compensation system)

a Current per sidewall length picked up from cathode flexibles into the collector bars, [kA/dm]

b Constant between 0.5 and 1, depending on the current collector bar cross-section variation along the length.

$l_1$ Length of extra upstream busbars, perpendicular to the overall line current direction, in addition to current collector bars, internal compensation [dm]

$l_2$ Length of the extra downstream busbars, perpendicular to the overall line current direction, in addition to current collector bars, internal compensation [dm]

The linear relation between the weight and the current for the external compensation, and the second-order relation between the weight and the current for the internal compensation method, make the methods best fit for different compensation current levels.

From the slopes of equations 2 and 3 plotted in FIG. 6, we see that the increased weight per current unit is lower for ICC than for ECC, at low compensation currents, while the situation is opposite for the higher compensation currents.

A natural point for introducing the CCS is where the two equations have the same slope. Up to this point, the cell should be compensated by an ICS, while all the extra compensation needed above this point should be done with an external compensation.

The comparison of the slopes of equation 2 and 3 could be written in this form:

$$\left.\frac{\partial m_{CCS,IC}}{\partial I_{CCS}}\right|_{I_{CCS,EC}=0} > \left.\frac{\partial m_{CCS,EC}}{\partial I_{CCS}}\right|_{I_{CCS,IC}=0} \tag{4}$$

Performing derivation of equation (4):

$$\frac{\delta}{i}\cdot\left(l_1+l_2+2\cdot I_{CCS,IC}\cdot\frac{b}{a}\right)>\frac{\delta}{i}\cdot l_3 \quad (5)$$

Simplified:

$$l_1+l_2+2\cdot I_{CCS,IC}\cdot\frac{b}{a}>l_3 \quad (6)$$

Valid range for CCS is then when the total compensation current, $I_{CCS}$, satisfy the condition:

$$I_{CCS}>\frac{a}{2\cdot b}(l_3-(l_1+l_2)) \quad (7)$$

The ICS part (constant) of the CCS is then defined by:

$$I_{CCS,IC}>\frac{a}{2\cdot b}(l_3-(l_1+l_2)) \quad (8)$$

The ECS part of the CCS is defined by:

$$I_{CCS,EC}=I_{CCS}-I_{CCS,IC} \quad (9)$$

In practice, the introduction of the $I_{CCS,EC}$ will be done at a somewhat higher compensation need, than indicated by equations (5), (6) and (7), due to the fact that 1. The introduction of ECS triggers extra costs, which means that the ECC must be of a certain size, before it is profitable.
2. The ECS is expected to be located at a higher distance to the pot head than the ICS. This makes the ECS less effective, and moves the introduction limit upwards.

When studying the nature of the internal compensation system, it is realized that this method contains inherent elements, which are superior and valid, even when used together with external compensation.

The internal compensation system has five advantages, compared to the external compensation system:

The current used for compensation is deducted from the current passing beneath the cell (part of the line current), i.e. the row compensation need is reduced.

By manipulating the line current and when no extra magnetic field sources are introduced, an extra reason for adverse effects on neighbour row(s) are avoided. An external compensation method results both in a significantly higher current, which needs to be compensated, and in a reduced distance between the disturbing current and the cell, which generates an extra need for compensation.

The upstream line current must pass by the cell, to the risers of the next cell anyway. In this specific direction no extra busbar weight has to be added to carry out the internal compensation.

The electrical potential difference between the compensated pot and the compensation busbar is very low, so safety issues are easier to handle.

Operating stability of reduction cells may be strongly jeopardized at breakdown of the external loop. A internal compensation system does not have this weak point, and therefore a combined compensation system is expected to be less sensitive to a breakdown of the external compensation loop.

It is these advantages, which make the combined compensation superior to the method of external compensation, when the method of solely internal compensation becomes inferior to solve the magnetic stability problem. The share of the compensation, handled by the internal compensation, as a function of compensation need, is illustrated in FIG. 7.

The magnitude of the compensation current must be related to the magnetic field to be compensated. The magnetic field strength, B, is a function of the magnitude of, and distance to the source. FIG. 8 indicates the relationship between the inter-row distance, the magnitude of the current (200 to 600 kA) and the resulting compensation current needed to neutralize the source (neighbour row).

For prevailing physical dimensions, current densities and materials, $I_{ICCS,IC}$ will end up somewhere between 30 and 70 kA. Putting this compensation level into FIG. 8 it is seen that a line current of about 300 kA is the upper limit for using exclusively the method of internal compensation in a double potroom (row distance about 30 m).

By utilizing combined compensation, previous limitations of line current can be raised for potlines at low inter-row distances (including double potrooms). This is relevant where available space is expensive or not available, see FIG. 9, mark a and b.

It should be understood that also the $B_x$- and especially the $B_y$-components contributes to a destabilisation of the cell, and must be taken care of when designing the busbar system.

The combined compensation method is also the best solution for another range of applications, where there is less need and focus on inter-row distance.

Long pots (carrying high line current), with a significant part of the upstream line current carried in busbars below the cell, generate a need for high compensation currents. Although the need for neighbour row compensation is moderate when the inter-row distance is getting longer, the need for row compensation current is added on top of the need for neighbour row compensation, ending up with a total compensation need that is higher than what is efficient to carry out with internal compensation only. The best solution is then to use combined compensation in such cases.

In addition to the stability, weight, busbar complexity and voltage drop, the design must be according to the "state-of-the-art", including other criteria like:

Maximum temperature of busbars and anode risers.

It must not complicate the pot operation.

Ventilation of cathode steel shell should be as free as possible.

SHE (safety, health, environment) must be satisfied.

It must be room for future amperage increase in the potline.

It should be mentioned that the invention can be further improved by arranging the cathode current distribution in an unsymmetrical manner. In particular, the distribution from upstream side can be between 40 and 50 percent of the line current, preferably between 45 and 50%. This arrangement implies that less current have to be carried beneath or outside the pot by the busbar system, i.e. the complexity of the system itself may be reduced.

DETAILED DESCRIPTION OF THE FIGURES

FIG. 1. Cross Section of One Prior Art Potline.

The figure illustrates the terminology used in the present document. It illustrates an ECS. The pot on the right-hand side is equipped with upstream current below the cell [1], and external compensation busbars on the inside (towards the neighbour row) and on the outside of the pot footprint [2].

The pot on the left-hand side is simplified to make the calculation of the magnetic influence on the pot on the right-hand side easier, line current [3] and external compensation [4].

The distance R is the inter-row distance.

FIG. 2. $B_z$ Field in Electrolyte-Metal Level in a Prior Art Cell.

Illustration of the uncompensated and the compensated $B_z$ fields in an ECS, without influence from a neighbour row.

All the line current is carried below the pot, and all the row current compensation is achieved by external compensation at the inside and outside of the pot footprint, similar to FIG. 5 in U.S. Pat. No. 4,713,161.

FIG. 3. Single and Double Potrooms Prior Art Solutions.

The two cross-sections at the top is a sketch of a single potroom system, while the one at the bottom is a double potroom system.

Single potroom system [1] can be arranged with cell rows [2] towards the inner wallsone cell row towards the inner wall and one cell row toward the outer wall cell rows towards the outer walls FIG. 4. Compensation Below and Beside the Pot Head in a Prior Art Cell.

An illustration of an internal compensation ($B_z$) beside and below the pot.

The pot heads are located at 7.0 and −7.0 meter

FIG. 5. Voltage-Drop/Weight/Stability Dilemma.

Illustration of the voltage drop/weight/stability dilemma related to the design of a circuit for electrical connection between two successive cells in a row.

I. Reduce the line current, or scale up busbar weight

II. Increase the line current, or scale down busbar weight

III. Increase weight of compensation busbars due to Increased stability needs or poor busbar design IV. Reduce weight of compensation busbars due to Sacrificed stability or clever busbar design FIG. 6. Extra Busbar Weight In the region where the current is picked up in the internal compensation system, two busbar shapes are relevant:

A prismatic shape might be used to minimise weight

A quadratic shape might be used to optimise current distribution

FIG. 7. Share of Internal Compensation.

Illustration of the internal compensation share, as a function of the compensation need. The rest of the compensation need is fulfilled with external compensation.

FIG. 8. The Influence of the Inter-Row Distance

A simplified relationship between the neighbour row current, inter-row distance and the compensation current looks like this. The equi-current lines should be seen as the sum of the line current and the ECC.

Only compensation for the neighbour row current, and not the row current, is illustrated in this figure.

At a given line current, a stable operating pot could either be reached by increasing the compensation current, or by increasing the inter-row distance.

FIG. 9. Categories of Pots to be Compensated

It is important to note that the region named c is mainly compensating the row current itself and not that of the neighbour row. This method is simply introduced because of the cell length (line current).

In the a and b regions it could be more attractive to switch from a double to a single potroom, instead of adding extra compensation current.

FIG. 10. Layouts of the Different Combined Compensations

FIG. 10.*a* Terminology

FIG. 10.*b* Compensating a medium high row current, and a neighbour row at a low distance (double potroom)

FIG. 10.*c* Compensating a high row current, and a neighbour row at a low distance (double potroom).

FIG. 11. The Effects of ICS, ECS and CCS at 350 kA

The uncompensated, the compensation and the compensated Bz field in a ICS (top left), ECS (top right) and CCS (bottom) for a 350 kA cell in a double potroom.

FIG. 12. Large Cell and Different Inter-Row Distances.

This figure relates to compensation of large cells arranged at different inter-row distances. The present invention is in particular applicable for this type of arrangements.

Embodiment

An Example of a 350 kA Pot in a Double Potroom.

The selection of a double potroom could be related to the available space, or site preparation cost. If there is free space at a reasonable cost, it could be more economical to choose two single potrooms, instead of the double potroom solution.

When compensating a high amperage cell in a double potroom, the compensation current itself, creates a large amount of extra compensation need, particularly in the case of ECS. The influence of such dependence makes some of the FIGS. (8 & 9) in this paper less readable, since the figures relate to the sum of the linecurrent and the external compensation current.

Just presenting the currents and weights for the ICS and ECS for the inner pot head reduces the example size. The example conforms to the data given in FIG. 10.*b*, and to type a in FIG. 9. FIG. 10.*a* shows the terminology, while 10.c shows a 450 kA (type b, FIG. 9) version.

| | Type (FIG. 10) | Compensation need* [kA] | Weight of extra busbars [tonnes] |
|---|---|---|---|
| Internal compensation | ICS | 72 | 5.3 |
| External compensation | ECS | 190 | 9.2 |
| Combined compensation | CCS | 35 + 65 | 4.6 |

*Calculated with a simple program taking into account the $B_Z$-influence from busbars below and beside (including neighbour row(s)) the pot analysed. Based on Biot-Savart's law, not taking iron parts into consideration.

Boundary Conditions Used:

| | | Unit | Value |
|---|---|---|---|
| Line current | I | kA | 350 |
| % upstream current | | % | 48 |
| Height between electrolyte/metal and busbars below the cell | h | m | 1.3 |
| Inter-row distance | R | m | 30 |
| Cell length | | m | 14 |
| c-c distance, cell to cell centre | $l_3$ | dm | 60 |
| Current per cathode flex | | kA | 6.3 |
| Distance between cathode flex | | dm | 5.8 |
| Current density, busbar | i | kA/dm$^2$ | 3.33 |
| Density, aluminium | r | kg/dm$^3$ | 2.7 |
| Distance to compensation busbar* | | dm | 1 & 2 |

*The EC busbar is placed 1 meter further away from the pot head, compared to the IC busbar. This is done due to safety considerations.

The extra weight of the internal compensation system is calculated by equation (3).

The extra weight of the external compensation system is calculated by equation (2)

The extra weight of the combined compensation system is calculated by equations (2) and (3), with the current distribution as illustrated in equation (9).

Typical percentage distribution between $m_{CCS,IC}$ and $m_{CCS,EC}$ is illustrated in FIG. 7.

The figure also illustrates the superiority of the CCS solution, since it shows that the $m_{CCS,IC}$ provides more than its share of the compensation current, provided the same pot stability level and specific energy loss in the ICS and the ECS.

In FIG. 7 the IC is kept at 40 kA for the whole span of combined compensation solutions. Examplified A 50 kA compensation need gives 80% internal compensation, which is 40 kA.

A 100 kA compensation need gives 40% internal compensation, which is 40 kA.

An Example of a 600 kA Pot in Single Potrooms.

As for the previous example, only the currents and weights for the IC and EC for the inner pot head is presented. The example conforms to the data given in FIG. 12.

| | Type | Compensation need* [kA] | Weight of extra busbars [tonnes] |
|---|---|---|---|
| Internal compensation | ICS | 70 | 4.8 |
| External compensation | ECS | 175 | 8.5 |
| Combined compensation | CCS | 35 + 58 | 4.3 |

The CCS is here superior to the ICS and the ECS.

The invention claimed is:

1. A method for operating high-intensity electrolysis cells of the Hall-Héroult type for producing aluminium, the cells being successively arranged in one or more series, where a first electric current sustains the electrolysis process in each cell, this current being named the line current, where the arrangement of the line current passing through each individual cell reduces the unwanted magnetic field in the cell, acting as an internal compensation current (CCS,IC) and where a second, separate current is provided to compensate for the remaining unwanted magnetic field in each individual cell, where said second separate current is named external compensation current (CCS,EC), wherein the internal compensation current (CCS,IC) , has at least one component that is located outside the cell footprint, around at least one pot head of the cell, where the said component of the internal compensation current (CCS,IC) is between 5 and 25% of the line current, and that the arrangement and the balance between the internal compensation system (CCS,IC) and the external compensation system (CCS,EC), denoted as a combined compensation system (CCS), is further designed in a manner optimising the weight and the voltage drop of the electrical connection system in accordance with the following steps:

I. CCS is applied when the compensation need, $I_{CCS}$, around at least one pot head is above the level:

$$I_{CCS} > \frac{a}{2 \cdot b}(l_3 - l_1 + 2))$$

II. if the inequality in step I. is fulfilled, then the amount of compensation current carried out with the internal compensation system (CCS,IC), around that pot head or both pot heads, is individually approximated to:

$$I_{CCS,IC} = \frac{a}{2 \cdot b}(l_3 - l_1 + 2))$$

III. the rest of the compensation need for that pot head or both pot heads, is carried out with an external compensation system (CCS,EC);

wherein the symbols have the following meaning:

$I_{CCS}$ Total compensation current for a combined compensation system $I_{CCS,IC}$ Internal compensation current for a combined compensation system a Current per sidewall length picked up from the cathode flexibles into the collector bar b Constant between 0.5 and 1 depending on the collector bar cross-sectional area variation along the length, $l_1$ Length of the extra upstream busbars, perpendicular to the overall line current direction, in addition to the collector bars, internal compensation $l_2$ Length of the extra downstream busbars, perpendicular to the overall line current direction, in addition to the collector bars, internal compensation $l_3$ c-c distance, from cell number n to n+1.

2. Method in accordance with claim 1, wherein the magnitude of the external compensation current (CCS,EC) is between 5 and 80% of the magnitude of the line current.

3. Method in accordance with claim 1, wherein the cathode current distribution from upstream side is between 40 and 50 percent of the line current, preferably between 45 and 50%.

4. Method in accordance with claim 1, wherein the row distance is between 25 and 150 m.

5. Method in accordance with claim 1, wherein the line current is between 300 and 600 kA.

6. Method in accordance with claim 3, wherein at least one part of the internal compensation current that is distributed outside the cells footprint is distributed at a vertical height close to that of the electrolyte/metal interface.

7. Electrical connecting and magnetic compensation system in one or more series of high intensity electrolysis cells of the Hall-Héroult type for producing aluminium, the cells being successively arranged in one or more series, the system delivers to the cells a first electric current that sustains the electrolysis process in each cell, this current being named line current ,where the arrangement of the line current passing through each individual cell reduces the unwanted magnetic field in the cell acting as an internal compensation current (CCS,IC), and where a second, separate current is provided to compensate for the remaining unwanted magnetic field in each individual cell where said second separate current is named the external compensation current (CCS,EC), wherein the internal compensation current (CCS,IC) has at least one component that is located outside the cell footprint, around at least one pot head of the cell, where the said component of the internal compensation current (CCS,IC), is between 5 and 25% of the line current, and that the arrangement and the balance between the internal compensation system (CCS,IC) and the external compensation system (CCS,EC), denoted as combined compensation system (CCS) is further designed in a manner optimising weight and voltage drop of the electrical connecting system accordingly, where the amount of compensation current carried out with the internal compensation system (CCS,IC), around one or both pot head(s), is individually approximated to:

$$I_{CCS,IC} = \frac{a}{2 \cdot b}(l_3 - l_1 +_2))$$

wherein the rest of the compensation need, for that pot head(s), is carried out with the external compensation system (CCS,EC), and CCS is applied when the compensation need, $I_{CCS}$, around at least one pot head is above the level:

$$I_{CCS} > \frac{a}{2 \cdot b}(l_3 - l_1 +_2))$$

wherein the symbols have the following meaning:

$I_{CCS}$ Total compensation current for a combined compensation system $I_{CCS,IC}$ Internal compensation current for a combined compensation system a Current per sidewall length picked up from cathode flexibles into collector bar b Constant between 0,5 and 1 depending on the collector bar cross section variation along the length, $l_1$ Length of extra upstream busbars, perpendicular to overall line current direction, in addition to collector bars, internal compensation $l_2$ Length of extra downstream busbars, perpendicular to overall line current direction, in addition to collector bars, internal compensation $l_3$ c-c distance, from cell n to n+1.

8. System in accordance with claim 7, wherein at least one of the busbars is arranged at a vertical height similar to the level of the electrolyte/metal interface.

9. System in accordance with claim 7, wherein the two individual electrical conductor systems have different electrical potentials.

10. System in accordance with claim 7, wherein the two individual electrical conductor systems could have common, or separate electric current sources (rectifier groups).

11. System in accordance with claim 7, wherein the designed amount of current in the ECS part of the CCS increases as the inter-row distance decreases.

12. System in accordance with claim 7, the electrolysis plant comprising two or more series of cells, wherein the row distance is between 25 and 150 m.

13. System in accordance with claim 7, the electrolysis plant comprising two or more series of cells, wherein the line current is between 300 and 600 kA.

14. System in accordance with claim 7, wherein the CCS is arranged in a way that makes future installation or current increase of neighbour potlines possible.

15. System in accordance with claim 7, wherein the CCS is arranged in a way that makes all ordinary actions, and future improvement/ upgrading possible.

16. System in accordance with claim 7, wherein the CCS is arranged in a way that makes temporary shutdowns possible.

* * * * *